US006786066B2

(12) United States Patent
Okamoto

(10) Patent No.: US 6,786,066 B2
(45) Date of Patent: Sep. 7, 2004

(54) KNIT WEAR WITH COLLAR KNIT BY FLAT KNITTING MACHINE AND METHOD OF KNITTING IT

(75) Inventor: Kazuyoshi Okamoto, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/476,681

(22) PCT Filed: Apr. 30, 2002

(86) PCT No.: PCT/JP02/04345

§ 371 (c)(1),
(2), (4) Date: Nov. 5, 2003

(87) PCT Pub. No.: WO02/090637

PCT Pub. Date: Nov. 14, 2002

(65) Prior Publication Data

US 2004/0154342 A1 Aug. 12, 2004

(30) Foreign Application Priority Data

May 8, 2001 (JP) ..... 2001-138017

(51) Int. Cl.[7] ..... D04B 7/30
(52) U.S. Cl. ..... 66/172 R; 66/176; 66/64
(58) Field of Search ..... 66/60 R, 64, 69, 66/70, 76, 169 R, 170–172 R, 175, 176

(56) References Cited

U.S. PATENT DOCUMENTS

| | | | | |
|---|---|---|---|---|
| 5,257,514 A | | 11/1993 | Okuno | |
| 5,388,430 A | | 2/1995 | Essig | |
| 5,417,088 A | | 5/1995 | Nakai | |
| 5,584,197 A | | 12/1996 | Okuno | |
| 5,836,177 A | | 11/1998 | Okuno et al. | |
| 5,943,884 A | * | 8/1999 | Kobata et al. | 66/176 |
| 5,956,975 A | | 9/1999 | Kawashima | |
| 6,668,593 B2 | * | 12/2003 | Okamoto | 66/64 |

FOREIGN PATENT DOCUMENTS

| | | |
|---|---|---|
| JP | 3-75656 B2 | 12/1991 |
| JP | 7-70885 A | 3/1995 |
| JP | 7-72385 B2 | 8/1995 |
| JP | 2514489 B2 | 7/1996 |
| JP | 2946325 B2 | 9/1999 |

* cited by examiner

*Primary Examiner*—Danny Worrell
(74) *Attorney, Agent, or Firm*—Rothwell, Figg, Ernst & Manbeck, P.C.

(57) ABSTRACT

Knitting for joining a body 3 including right and left body portions and a neckline 12 and a collar together. A neckline 12 comprises at least three neckline portions comprising a first neckline portion 12*d* formed in one body portion 13 of right and left body portions which is formed earlier than the other body portion, a second neckline portion 12*b* formed in the other body portion 15, and a third neckline portion 12*a* formed in the body 5 formed later. A knitted fabric of the collar 11 comprises three collar portions comprising a first collar portion 11*d* joined to the first neckline portion 12*d*, a second collar portion 11*b* joined to the second neckline portion 12*b*, and a third collar portion 11*a* located at an outside of the first and/or the second collar portions and joined to the third neckline portion 12*a*. Loops of the first neckline portion 12*d* and loops of the first collar portion 11*d* are joined to each other by transference of loops in the course of knitting of the one body portion 13 and, then, loops of the second neckline portion 12*b* and loops of the second collar portion 11*b* are joined to each other by transference of loops in the course of knitting of the other body portion 15. Finally, the third collar portion 11*a* is moved to a neckline opening 4 in such a condition that the loops of the third collar portion 11*a* are arrayed in an opposite direction, so that the third neckline portion 12*a* and the body 5 are joined to each other by knitting the body 5 following the knitting of the loops of the third collar portion 12*a*.

7 Claims, 10 Drawing Sheets

KNIT WEAR WITH COLLAR KNIT BY FLAT KNITTING MACHINE AND METHOD OF KNITTING IT

CROSS REFERENCE TO RELATED APPLICATION

This application is a 35 USC § 371 National Phase Entry Application from PTC/JP02/04345, filed Apr. 30, 2002, and designating the U.S.

TECHNICAL FIELD

The present invention relates to knitwear with collar, such as a sweater and a cardigan, integrally knitted around a neckline of the knitwear by using a flat knitting machine, and to a knitting method thereof.

BACKGROUND ART

Knitting methods of knitting knitwear with collar integrally knitted around a neckline of the knitwear by using a flat knitting machine are known from Japanese Laid-open (Unexamined) Patent Publications No. Hei 6-184886 and Hei 4-214448, for example.

Japanese Laid-open (Unexamined) Patent Publications No. Hei 6-184886 cited above discloses the knitting method wherein a front body is knitted starting at a hem toward a shoulder and a V-shaped or round neckline is formed around a shoulder area and, then, a back body is knitted from the shoulder to the hem continuously. In this knitting method, when the front body is knitted, it is forked into a right front body part and a left front body part at a neckline opening and a part of either of those front body parts on the neckline side is knitted as the collar. The collar is often knitted with a purl stitch structure of front stitches and back stitches being alternated with each other in every course. This knitting method is advantageous in that since the collar is integrally knitted with the body in the course of knitting, the need of the sewing process after knitting, such as linking, can be eliminated. It is disadvantageous, however, in that a wale at a lateral end of the front body appears at an end of the collar and that the stitches of the collar are oriented in the same direction as the stitches of the body.

Japanese Laid-open (Unexamined) Patent Publications No. Hei 4-214448 cited above discloses the knitting method wherein after the front body is forked into the right front body part and the left front body part at the neckline opening, one front body part to be knitted is shifted away from the neckline and also widening stitches are formed around a marginal end of the neckline, whereby a peripheral length of the neckline is increased and also a front drop of the collar is formed. In this knitting method, after the front body is knitted to form a square or round neckline in the front body, the collar is knitted continuously from the stitches in the neckline opening. Due to this, an increased number of times the widening stitches are formed is required for obtaining an increased depth of the neckline (collar drop), but this is not easy. In addition, in this knitting method, the cast-off end forms the front end of the collar.

On the other hand, in the knitwear finished by stitching up a collar to the neckline by a conventional sewing process, since a cast-off end of the collar separately knitted is stitched up to the neckline of the body, the cast-on end of the collar forms a front end of the collar, so that a well-shaped collar is obtained. Besides, since the collar is often knitted with a rib stitch structure of 1×1 rib or a tubular knit structure of plain, the collar obtained is different in texture and look-and-feel from that of the body of the knitwear having the purl stitch structure.

Further, Japanese Patent Publication No. Hei 3-75656 discloses a knitting method: using a so-called two-bed flat knitting machine having a pair of front and back needle beds arranged to be opposite to each other. In this knitting method, for example, odd needles on the needle beds are used for a front part of a knitted fabric and even needles are used for a back part of the knitted fabric. When the front part of the knitted fabric is knitted with alternate needles, the back part of the knitted fabric is retained on (associated with) the back needle bed, while on the other hand, when the back part of the knitted fabric is knitted, the front part of the knitted fabric is associated with the front needle bed, so as to knit the front and back parts in an overlapped condition. Thus, in this method using the two-bed flat knitting machine, the empty needles for transference can always be reserved for the respective parts of the knitted fabric on the opposed needle beds, thus enabling the knitting of the structure pattern of front stitches and back stitches being mixed, such as links, garter and rib, and also enabling the stitches to be shifted laterally. Additionally, the knitting method using a four-bed flat knitting machine is also known, wherein for example needles on a lower front needle bed and needles on an upper back needle bed are used for knitting a front part of the knitted fabric and needles on a lower back needle bed and needles on an upper front needle bed are used for knitting a back part of the knitted fabric. When the front part of the knitted fabric is knitted, the back part of the knitted fabric is associated with the lower back needle bed, while on the other hand, when the back part of the knitted fabric is knitted, the front part of the knitted fabric is associated with the lower front needle bed. This knitting method using the four-bed flat knitting machine does not have the limitation that the alternate needles are used for knitting the respective parts of the knitted fabric, differently from the knitting method using the two-bed flat knitting machine.

It is the object of the present invention to provide labor-saving in the post-process such as linking by joining the collar and the body to each other in the course of knitting and also provide a highly stylish knitwear with collar by making an arbitrary selection of the knitting structure of the collar including a rib stitch structure of 1×1 rib and a tubular knit structure.

DISCLOSURE OF THE INVENTION

The present invention provides knitwear with a collar comprising a front body and a back body, one of which is parted into a right body portion and a left body portion, and further comprising a neckline, wherein the neckline comprises at least three neckline portions comprising a first neckline portion formed at a lateral end of one of the right body portion and the left body portion which is formed earlier than the other, a second neckline portion formed at a lateral end of the other of the right body portion and the left body portion, and a third neckline portion formed in the body portion formed later, wherein a knitted fabric of the collar has a knitting width enough to be joined to an entire circumference of the neckline and comprises:

a) a first collar portion joined to the first neckline portion, b) a second collar portion joined to the second neckline portion, and c) a third collar portion located at an outside of the first and/or the second collar portions and joined to the third neckline portion, and wherein loops of the first neckline portion and loops of a final course of the first collar portion are joined to each other by forming double loops in the course of knitting of the body to form the first neckline portion; then loops of the second neckline portion and loops of a final course of the second collar portion are joined to each other by forming double loops in the course of knitting of the body to form the second neckline portion; and finally the third collar portion is moved to a neckline opening in such a condition that the loops of the third collar portion are arrayed in an opposite direction, so that the third neckline portion and the third collar portion are joined to each other by knitting a course of the body following the knitting of the loops of the final course of the third collar portion.

The knitted fabric of the collar may be a V-neck knitted fabric. Preferably, in the V-neck knitted fabric, whenever the knitted fabric is knitted by a predetermined number of courses, the collar portions are knitted to widen from a V-butt line of the V-neck as a center so that the knitted fabric of the collar can have a large number of wales in a cast-off portion thereof than in a cast-on portion thereof, and the neckline is knitted to decrease the knitting width of the body so as to correspond in shape to the V-neck form.

It is preferable that the neckline is a round or square neckline further including a fourth neckline portion having a predetermined number of wales inserted in between the right body portion and the left body portion, and the knitted fabric of the collar has a fourth collar portion between the first collar portion and the second collar portion, the fourth neckline portion and the fourth collar portion being joined to each other by a binding-off knitting.

Also, the present invention provides a method of knitting knitwear with collar by using a flat knitting machine, wherein a body comprising a front body and a back body, one of which is parted into a right body portion and a left body portion, and a knitted fabric of the collar knitted separately from the body are joined to each other in the course of knitting for forming a neckline in the body by using a flat knitting machine comprising at least a pair of first and second needle beds, which are extended laterally and confront each other in back and front and at least either of which can be racked laterally to transfer stitches between the needles beds, the method comprising:

a) the step of knitting the body from its hem to a forked portion at which the forming of the neckline is started, b) the step of knitting the knitted fabric of the collar separately from the body in parallel with or before or after the knitting of the body, c) the step of joining the knitted fabric of the collar to the body along circumference of the neckline, the step comprising the following steps:

c-1) the step of joining the knitted fabric of the collar to one body portion of the right and left body portions by overlapping loops of a collar portion of the knitted fabric of the collar confronting the one body portion, which extends from near a center of a knitting width of the knitted fabric of the collar to one outer end of the same, with a loop at a lateral end of the one body portion one after another from a loop near the center of the knitted fabric in the course of knitting the one body parted into the right body portion and the left body portion, and c-2) the step of joining the knitted fabric of the collar to the other body portion of the right and left body portions by overlapping loops of a collar portion of the knitted fabric of the collar confronting the other body portion, which extends from near a center of a knitting width of the knitted fabric of the collar to the other outer end of the same, with a loop at a lateral end of the other body portion one after another from a loop near the center of the knitted fabric in the course of knitting the other body.

It is preferable that the neckline has a flat neckline portion having a predetermined number of wales inserted in between the right body portion and the left body portion, and the flat neckline portion is joined to the collar portion of the knitted fabric of the collar located at a center of the knitting width by a binding-off process, followed by the step of the process c).

It is preferable that the knitted fabric of the collar is knitted to have a larger kitted width than a collar portion joined to the body around a neckline portion defined by lateral ends of the right and left body portions, so as to allow the knitted fabric of the collar to be joined to the body all around the neckline.

It is preferable that the body is knitted in such a manner that one of the front and back bodies is knitted from its hem to its shoulder and then the other is knitted to its hem continuously, so that the front body and the back body are knitted continuously along the shoulder, and also the neckline closed at an entire circumference thereof is formed in the course of knitting of the body, and wherein after the knitted fabric of the collar is sequentially joined to the neckline of the body knitted in sequence, the rest of the knitted fabric of the collar left without being joined to the neckline is place between the right body portion and the left body portion in such a condition that the loops of the rest of the knitted fabric of the collar are arrayed in an opposite direction and is joined to the body by performing a course knitting following the knitting of loops of that collar portion and loops of the body knitted to be parted right and left.

According to the present invention, loops in the lateral end portion of the body forming the first neckline portion and loops of a final course of the first collar portion are overlapped and joined to each other by transference of loops in the course of knitting of the one body portion of the right and left body portions. Then, loops in the lateral end portion of the body forming the second neckline portion and loops of a final course of the second collar portion are overlapped and joined to each other by transference of loops in the course of knitting of the other body portion of the right and left body portions. Then, after the third collar portion is moved to a place where the third neckline portion is formed, in such a condition that the loops of the third collar portion are arrayed in an opposite direction, the body is knitted continuously to be joined to the third collar portion. As a result of this, the knitted fabric of the collar, which is knitted separately from the body on the flat knitting machine during the knitting process, is joined to all around the neckline formed in the body in the condition that its cast-off portion confronts the entire circumference of the neckline. Since the knitted fabric of the collar is not knitted as a part of the body, as conventional, but is knitted independently of the body, the knitted fabric of the collar can be knitted with any desirable knitting such as a rib knitting and a tubular knitting. Also, since the cast-off portion of the knitted fabric of the collar thus knitted is joined to the body which is in the knitting process, the knitted fabric of the collar can be differed in orientation of loop from the body, thus enabling a knitwear that looks like a knitwear finished by a stitch-up process to be produced on the flat knitting machine. This can provide improvement in design of knitwear and can provide a highly stylish knitwear design. In addition, since the knitted fabric of the collar knitted separately from the body is sequentially joined to the neckline portion of the body while the neckline is formed in the body, as mentioned above, the knitting of the knitwear with collar can be facilitated. This can allow production of a variety of knitwear designs such as knitwear designed to have a large collar drop in the neckline.

The knitted fabric of the collar may be a V-neck knitted fabric. Preferably, the V-neck knitted fabric is knitted to gradually widen from the V-butt line of the V-neck as a center. This can provide the result that when no load is applied to the knitted fabric of the collar, the knitted fabric of the collar has an inverted generally V-shaped form with the V-butt line put upside down. This can allow the knitted fabric of the collar to well fit to the neckline which is knitted in such a manner as to decrease the knitting width of the body so as to have a V-shaped base portion of the neckline.

When the body is parted into a right body portion and a left body portion at a neckline forming portion, the fourth neckline portion having a predetermined number of wales may be inserted in between the right body portion and the left body portion. In this case, the fourth collar portion of the knitted fabric of the collar positioned between the first collar portion and the second collar portion is first joined to the fourth neckline portion by the binding-off process. This can produce the base portion of the neckline designed to be round or square in shape.

BEST MODE FOR CARRYING OUT THE INVENTION

In the following, certain preferred embodiments of the present invention will be described in detail with reference to the accompanying drawings. In the illustrated embodiments, a two-bed flat knitting machine of a general type having front and back needle beds, which have a number of knitting needles arranged in line, which confront each other in front and back, with the back needle bed capable of being racked laterally, and between which stitch is transferred, is used, though not shown.

Embodiment 1

Figure 1:
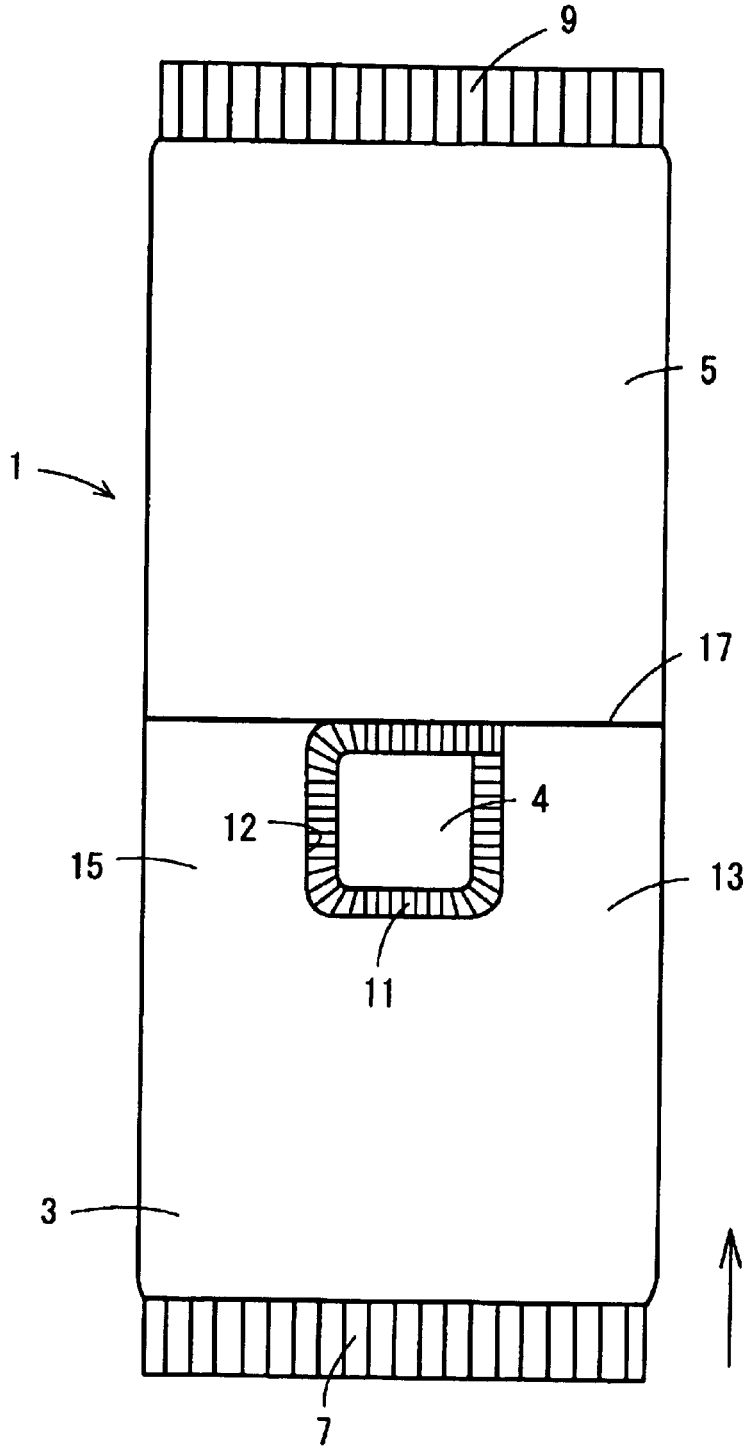
FIG. 1 is a view showing a schematic plan view of a vest knitted in the embodiment 1.
Figure 2:
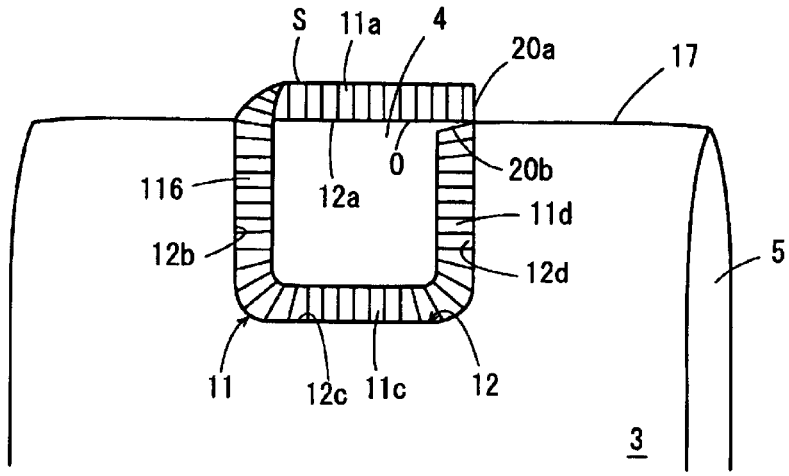
FIG. 2 is a view showing the vest of the embodiment 1 folded at the shoulder.
Figure 3:
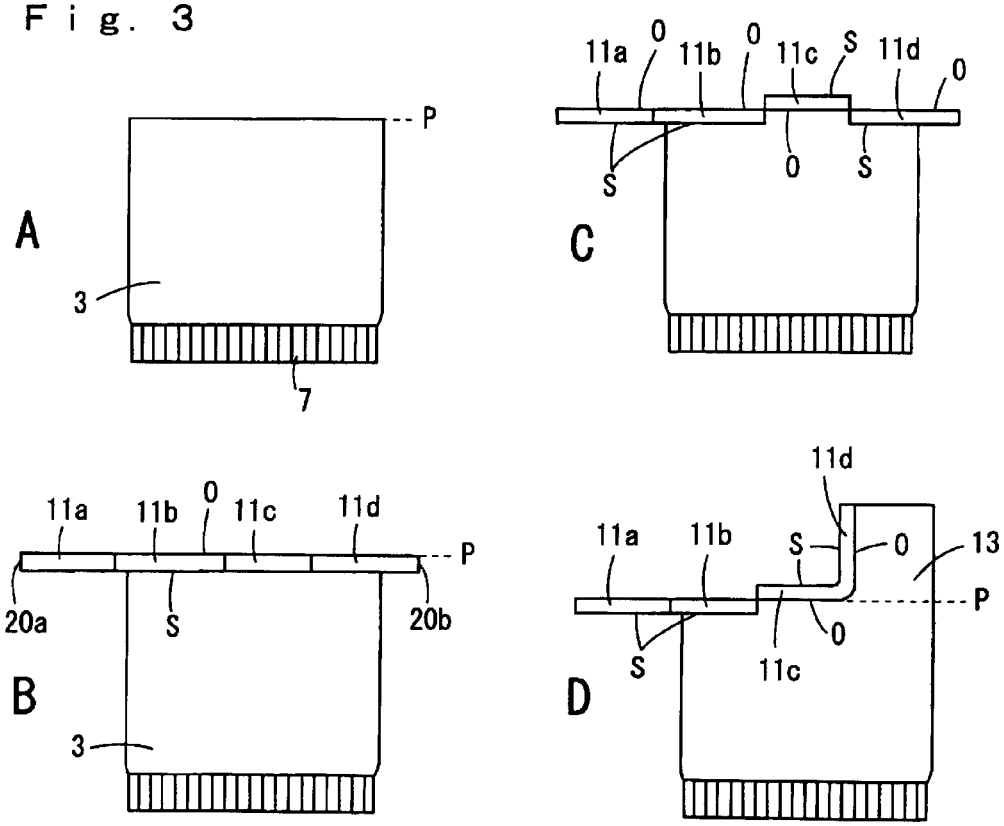
FIG. 3 is illustration schematically showing a first half of the process of joining a knitted fabric of a collar to a neckline of the vest in the embodiment 1.
Figure 4:
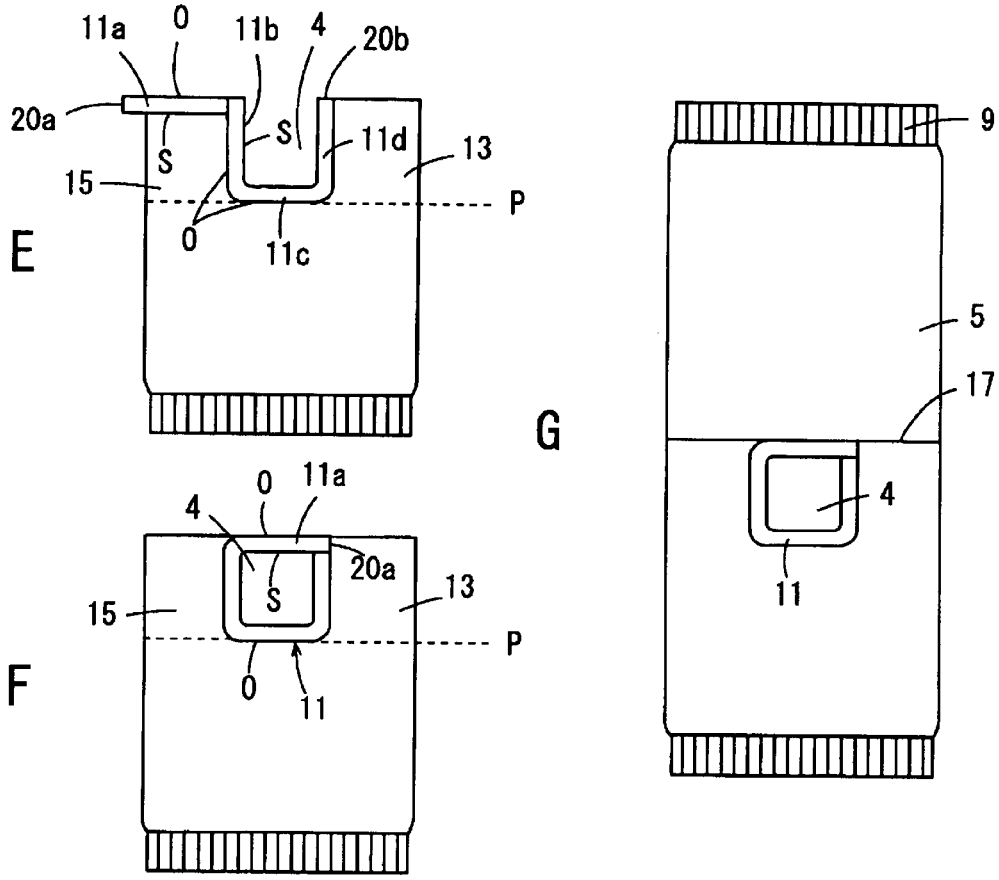
FIG. 4 is illustration schematically showing a second half of the process of joining the knitted fabric of the collar to the neckline of the vest in the embodiment 1.
Figure 5:
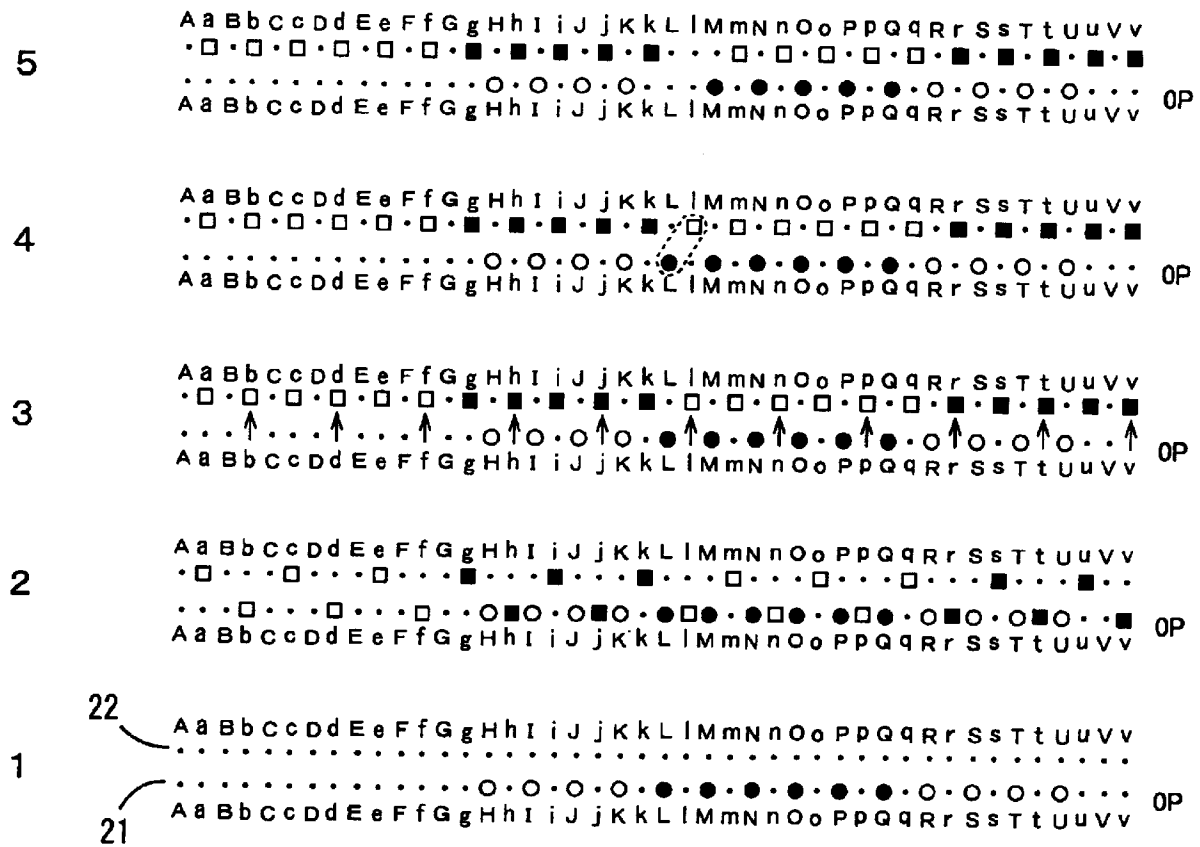
FIG. 5 is the knitting step diagram showing the details of the process of joining the knitted fabric of the collar to the neckline of the vest in the embodiment 1.
Figure 6:
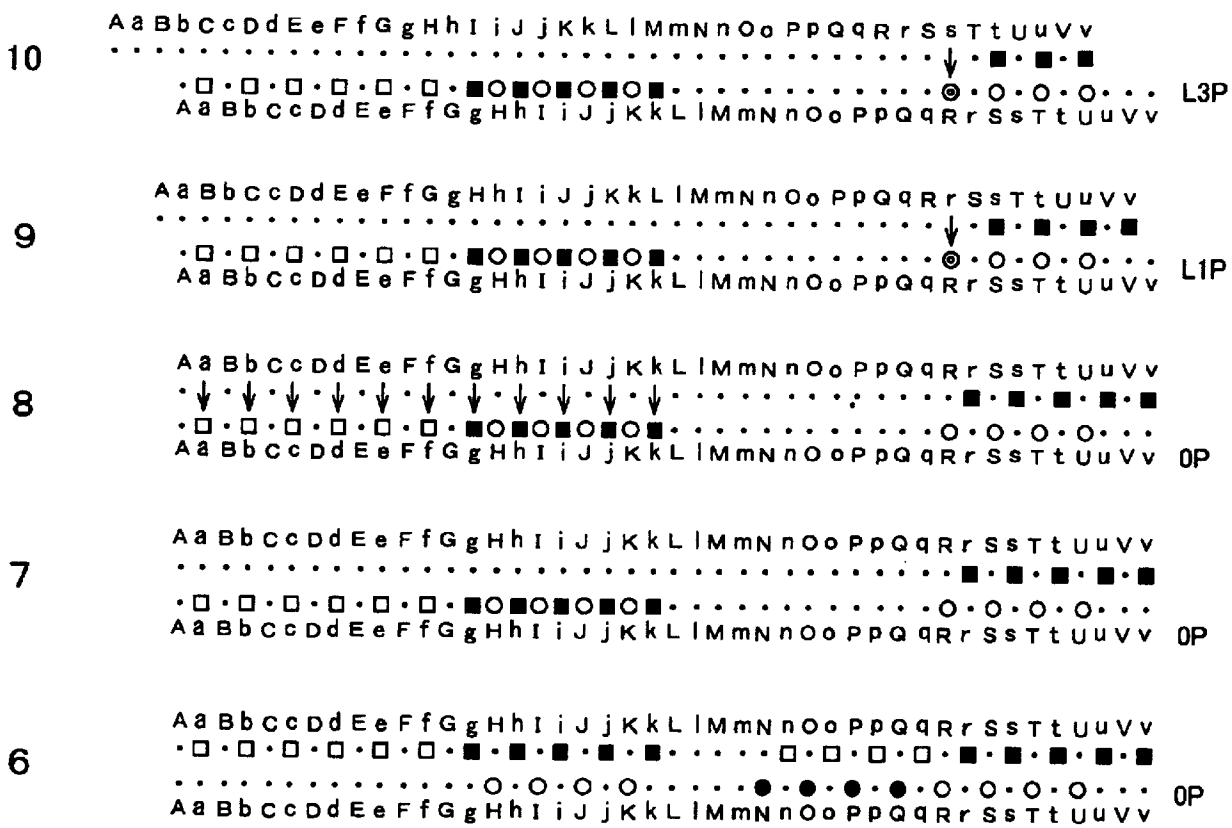
FIG. 6 is the knitting step diagram showing the joining process following the joining process of FIG. 5.
Figure 7:
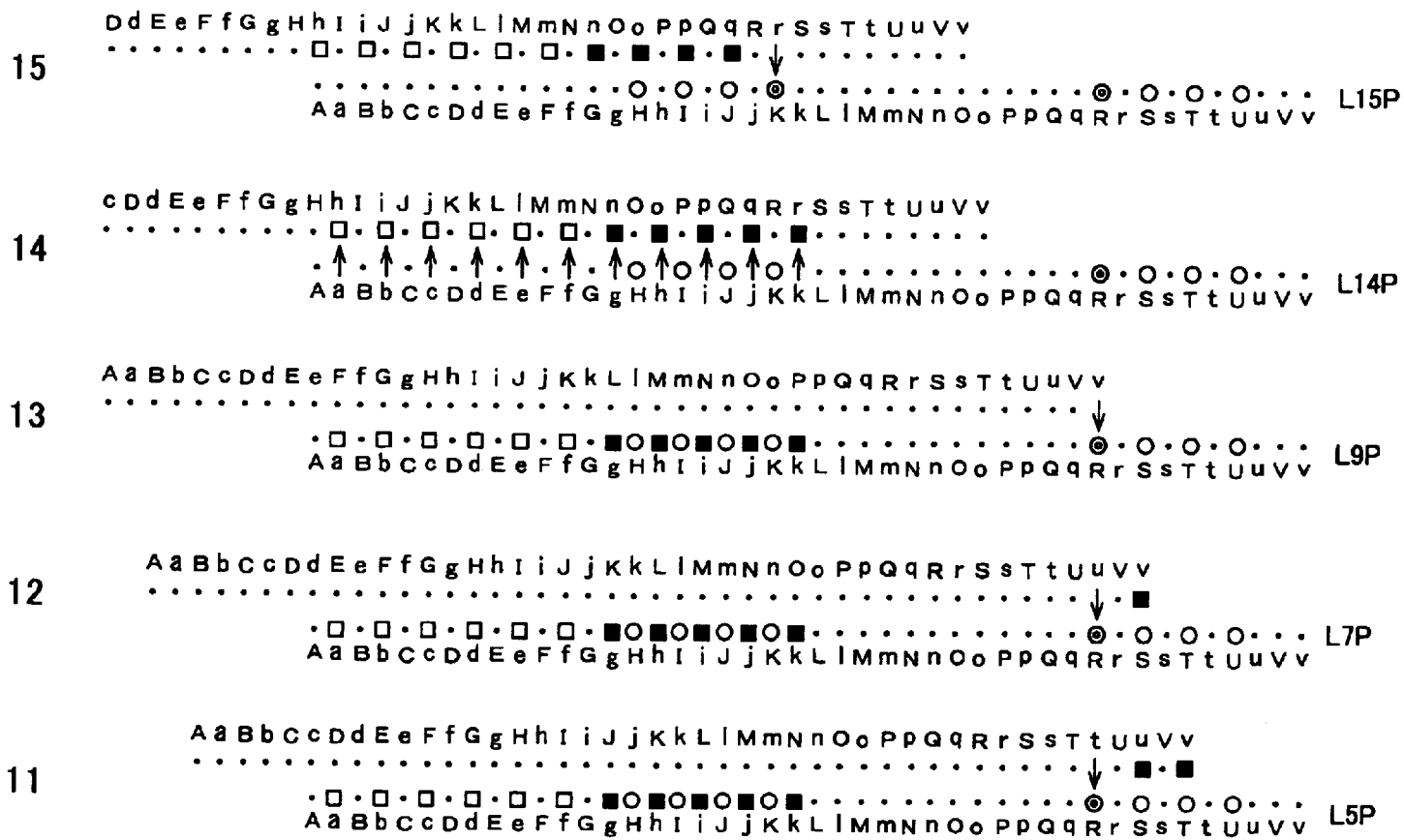
FIG. 7 is the knitting step diagram showing the joining process following the process of FIG. 6.
Figure 8:
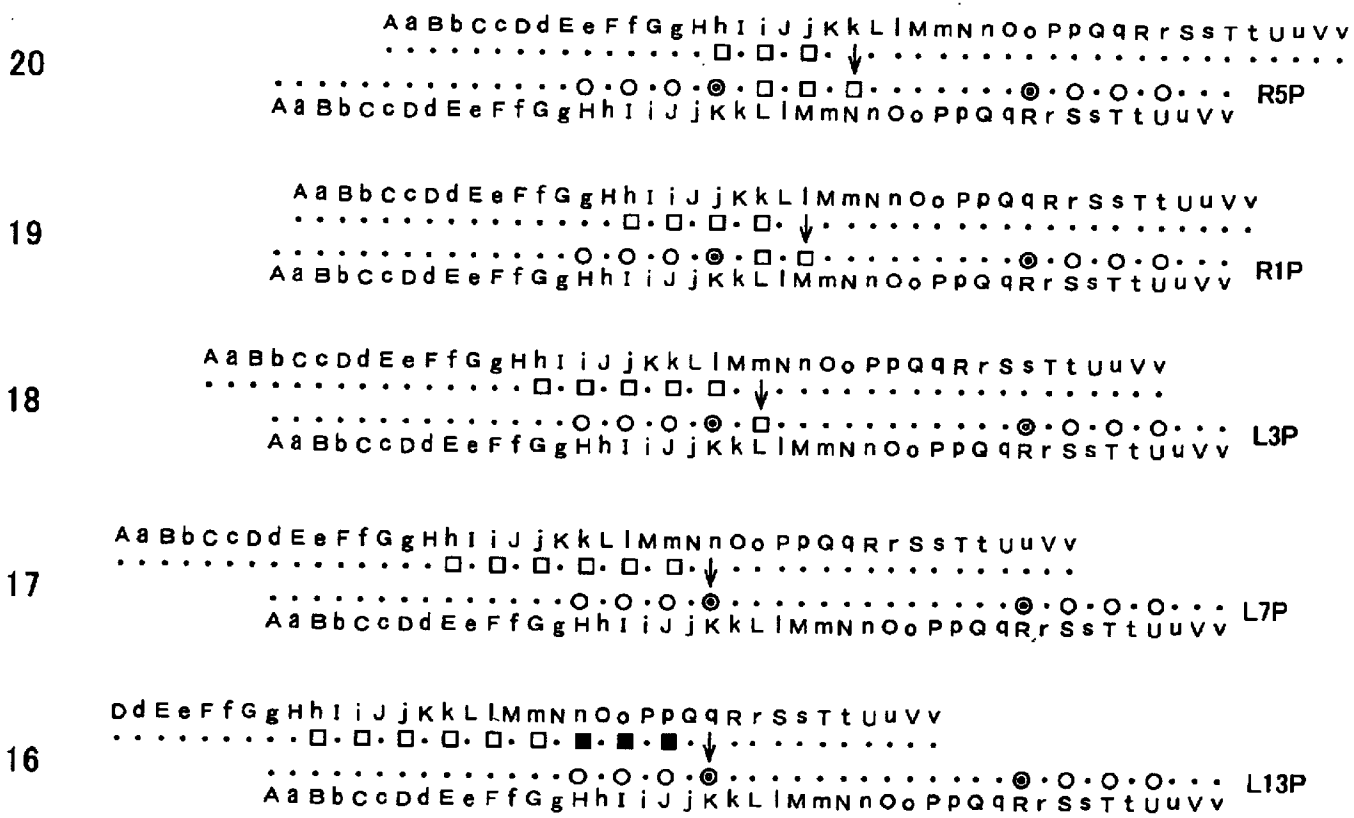
FIG. 8 is the knitting step diagram showing the joining process following the process of FIG. 7.
Figure 9:
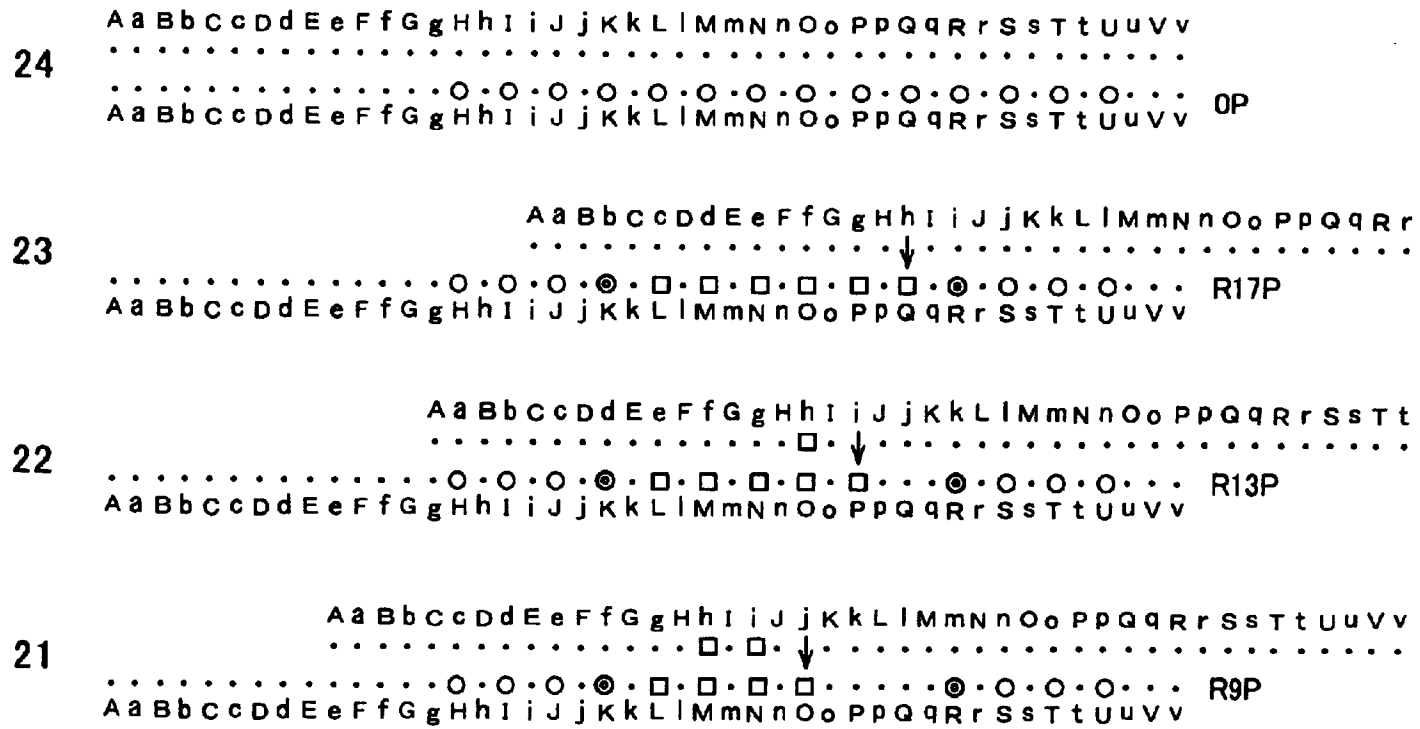
FIG. 9 is the knitting step diagram showing the joining process following the process of FIG. 8.

FIG. 1 shows a schematic plan view of a vest 1 knitted as knitwear in this embodiment The vest 1 has a U-shaped neckline 12 and a knitted fabric of a collar 11 knitted simultaneously and joined to the neckline 12 in the course of knitting. A front body 3 and a back body 5 of the vest I are both knitted with a plain structure, and the knitted fabric of the collar 11 is knitted with a rib stitch structure of 1×1 nib. FIG. 2 shows the knitted vest 1 which is in the state of being folded along a shoulder line 17. The front body 3 and the back body 5, after knitted, are stitched up together along sidelines thereof, and lateral ends (20*a*, 20*b* of FIG. 2) of the knitted fabric of the collar 11 are stitched up together as mentioned later, whereby the knitwear is finished. FIGS. 3 and 4 schematically show the knitting process of the vest 1 by using a flat knitting machine, particularly the process of joining a knitted fabric of a collar to a neckline of the vest FIGS. 5–8 show the knitting steps showing the details of the respective processes. The vest 1 is knitted starting at a hem 7 of the front body 3 toward a shoulder. As the knitting of the vest from the hem 7 to a line P at which the knitting of a neckline opening 4 of the front body 1 is started is known, the description thereon is omitted herein.

In the knitting step diagrams, for convenience of explanation, an even fewer number of needles used for the knitting than the actual number of needles used for knitting the knitwear is illustrated. The numerals at the left side of the drawings indicate the serial number of knitting. 21 denotes a front needle bed, and 22 denotes a back needle bed. The capital alphabetical letters indicate odd needles and the small alphabetical letters indicate even needles. The front body 3 of the vest 1 is knitted with the odd needles and the collar 11 is knitted with the even needles, both being knitted with alternate needles.

What are denoted by various marks in FIGS. 5–8 are as follows. Circles denote loops of a front body which is parted right and left, i.e., loops of a right front body and loops of a left front body. Black circles of the circles denote loops in a center portion of the front body in which a base of a neckline 12*c* (a fourth neckline portion) is formed. Squares denote loops of the knitted fabric of the collar 11, and white squares of the squares denote loops of a collar portion that comes to extend horizontally when joined to the body. A collar portion 11*a* joined to a neckline portion 12*a* (a third neckline portion) and a collar portion 11*c* (a fourth collar portion) joined to the base of the neckline 12*c* are arrayed from the left side. Black squares denote loops of a collar portion to extend vertically. A collar portion 12*b* (a second neckline portion) formed in the right front body 15 and a collar portion 12*d* formed in the left front body 13 are arrayed from the left side. Double circles denote double stitches and dots denote empty needles. Up-arrows and down-arrows denote transference of loops.

The step 1 shows the state that the knitted fabric knitted up to the line P is retained on the needle beds. The front body 3 is retained on the odd needles H-U of the front needle bed (which corresponds to the state of FIG. 3-A). In the following, letting the state wherein corresponding needles on the front and back needle beds confront each other, such as the state of the step 1, be a racking origin (OP), a racking distance of the needle bed from the racking origin is measured.

In the next step 2, the knitted fabric of the collar 11 having a rib stitch structure of 1×1 rib is knitted with a yam fed to even needles a-v of the front and back needle beds alternately. The knitted fabric of the collar 11 is knitted in the state in which it is retained on the back needle bed to confront the front body 3. The collar 11 may be knitted in parallel with the front body 3 or may alternatively be knitted before the front body 3 is knitted. In the latter case, the knitting of the collar 11 is started before the front body 3 is knitted up to the line P. During the knitting of the collar 11, the front body is kept in its retained state on the needles of the front needle bed. The knitted fabric of the collar 11 has a knitting width enough to be joined to an entire circumference of the neckline 12. The knitted fabric of the collar 11 comprises collar portions 11*a*, 11*b*, 11*c* and 11*d*. The collar portion 11*a* is joined to 12*a* of the neckline 12. 11*b* is joined to 12*b* of the neckline. 11*c* is joined to 12*c*, and 11*d* is joined to 12*d*. The knitted fabric of the collar portion 11*a* is knitted with needles a-f. 11*b* is knitted with needles g–k. 11*c* is knitted with needles l–g. 11*d* is knitted with needles r–v. Each of the collar portions 11*b* and 11*d* has six wales, and each of the collar portions 11*a* and 11*c* has five wales. Since the vest 1 of this embodiment is designed to have a U-neck of a large front drop, the collar 11 has a knitting width larger than that of the body 3. An alphabetical letter "S" given to the knitted fabric of the collar 11 denotes a "cast-on portion" of the collar and "O" denotes a "cast-off portion" of the same. From the line P, the front body 3 is forked into the right front body 15 and the left front body 13. The right front body is knitted with needles H-K and the left front body is knitted with needles R–U. The base 12*c* of the neckline is formed between the right and left front bodies. The step 3 illustrates the state that after the knitted fabric of the collar 11 are knitted, loops of the knitted fabric of the collar 11 knitted in the front needle bed are transferred to the back needle bed. In this step, the front body 3 is retained on the front needle bed, and the collar 11 is retained on the back needle bed (FIG. 3-B).

The steps 4–7 illustrate the knitting for joining the base 12*c* of the neckline of the front body and the collar portion 11c. In the step 4, the loop of the front body 3 retained on the needle L and the loop of the collar portion 11*c* retained on the needle l are bound off by a binding-off process. The knitting for the binding-off process proceeds from the left side to the right side when viewed in the diagram. The loops of the collar portion 11*c* of the collar and the loops of the front body 3 in the final course are prevented from loosening by this binding-off process. Any known binding-off process may be adopted. For example the binding-off process disclosed by Japanese Laid-open (Unexamined) patent publication No. Hei 9-241950 is preferably used according to which the loops of the front and back knitted fabrics are bound off while they are crossed each other so that the joining portion can be finished flat. The step 5 illustrates the state that after the loops are bound off in the step 4, they are released from the needles L, l. The step 6 illustrates the binding-off process to the needles M, m. The midterm steps are slipped. The step 7 illustrates the state that the binding-off process to the needles Q, q is completed. In this step, the base 12*c* of the neckline of, the front body and the collar portion 11c are joined and then released from the needles (FIG. 3-C). The course knitting for the base 12*c* of the neckline of the front body 3 is, finished at the line P. Prior to the binding-off process mentioned above, a flechage knitting may be performed so that the knitted fabric of the collar can have a larger number of courses in an outer collar portion thereof than in the center of the base 12*c* of the neckline so that the neckline portion 12*c* can be formed in a circular form.

The next steps 8–13 illustrate the knitting for joining the collar portion 11*d* and the neckline portion 12d formed at a lateral end of the left front body 13. First, in the step 8, the collar portions 11*a*, 11*b* are transferred to the front needle bed, so that only the collar portion 11*d* is retained on the back needle bed. In the next steps 9–13, whenever the left front body 13 is knitted by a predetermined number of courses, e.g., by two courses, the loops of the collar portion 11*d* retained on the needles r-v of the back needle bed are transferred from the needle r to the needle R at the lateral end of the left front body 13 sequentially and overlapped with it one after another. Specifically, in the step 9, after the back needle bed is racked leftwards three stitches, the collar portion 11*d* is, transferred to the needle R and overlapped with it In the step 10, after the back needle bed is racked leftwards three stitches, the collar portion 11*d* is transferred to the needle R and overlapped with it. In the step 11, after the back needle bed is racked leftwards five stitches, the collar portion 11*d* is transferred to the needle R and overlapped with it. In the step 12, after the back needle bed is racked leftwards seven stitches, the collar portion 11*d* is transferred to the needle R and overlapped with it. In the step 13, after the back needle bed is racked leftwards nine stitches, the collar portion 11*d* is transferred to the needle R and overlapped with it. The collar portion 11*d* and the neckline portion 12*d* are joined together in this manner (FIG. 3-D).

The next steps 14-17 illustrate the knitting for joining the collar portion 11*b* and the neckline portion 12*b* formed in the right front body 15. First, in the step 14, the collar portions 11*a*, 11*b* are transferred to the back needle bed. Before this transference of the loops, the back needle bed is racked leftwards fourteen stitches, in order to reduce the number of times the loops of the collar portion 11*a* are transferred or reciprocated between the front needle bed and the back needle bed. This knitting for joining is also performed whenever the right front body 15 is knitted by two courses, as is the case with the knitting for joining the neckline portion 12*d* and the collar portion 11*d*. After the loops of the collar portion 11*b* retained on the needles n-r of the back needle bed are transferred from the needle r to the needle K at a lateral end of the right front body 15 sequentially and overlapped with it one after another. Specifically, in the step 15, after the back needle bed is racked leftwards fifteen stitches, the collar portion 11*b* is transferred to the needle K and overlapped with it. In the step 16, after the back needle bed is racked leftwards thirteen stitches, the collar portion 11*b* is transferred to the needle K and overlapped with it. The midterm steps are skipped. In the step 17, after the back needle bed is racked leftwards five stitches, the collar portion 11*b* is transferred to the needle K and overlapped with it. The collar portion 11*b* and the neckline portion 12*b* are joined together in this manner (FIG. 4-E).

The next steps 18–23 illustrate the steps for moving the collar portion 11*a* to join it to the neckline portion 12*a* formed in the back body 5 to be knitted next In the step 18, after the back needle bed is racked leftwards three stitches, the loop of the collar portion 11*a* is transferred. In the step 19, after the back needle bed is racked rightwards one stitch, the loop of the collar portion 11*a* is transferred. In the step 20, after the back needle bed is racked rightwards five stitches, the loop of the collar portion la is transferred. In the step 21, after the back needle bed is racked rightwards nine stitches, the loop of the collar portion 11*a* is transferred. In the step 22, after the back needle bed is racked rightwards thirteen stitches, the loop of the collar portion 11*a* is transferred. In the step 23, after the back needle bed is racked rightwards seventeen stitches, the loop of the collar portion 11*a* is transferred. As a result of this, the collar portion 11*a* is moved to a position where the neckline portion 11*c* was located, so that the loops of the collar portion 11*a* are arrayed in an opposite direction (FIG. 4-F).

The next step 24 illustrates the course knitting of the back body 5. In the step 24, after the racked back needle bed is returned to the racking origin, the course knitting is performed by feeding the yarn to the needles H–U. This knitting is repeatedly performed to knit the back body 5. As a result of this, the back body 5 including the neckline portion 12*a* is knitted continuously from the final course of the collar portion 11*a*, whereby the neckline portion 12*a* and the collar portion 11*a* are joined together. Thereafter, the knitting of the back body 5 is finished at the hem 9 in a known manner.

The knitting method of the invention mentioned above enables the vest 1 to be knitted up in the state in which the knitted fabric of the collar 11 is joined to the neckline 12 formed in the body. The vest 1 thus knitted is finished in such a way that after the completion of armholes in the sequent sewing process, the front body and the back body are stitched up together along sidelines from the armholes to the hems and also the ends 20*a*, 20*b* of the knitted fabric of the collar 11 are stitched up together. Since the knitted fabric of the collar is joined to the body in such a condition that the cast-on portion of the collar can form the front end of the collar and the cast-off portion of the collar is joined to the body, the collar can be finished to have the same finished form as that of the knitwear finished by joining the knitted fabric of the collar to the neckline by the sewing process, differently from the collar formed in the conventional seamless knitting method.

Embodiment 2

Figure 10:
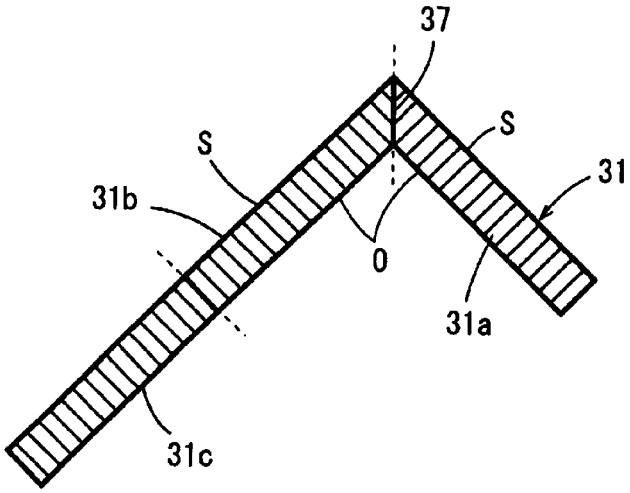
FIG. 10 is a view showing a knitted fabric of the collar knitted in the embodiment 2.
Figure 11:
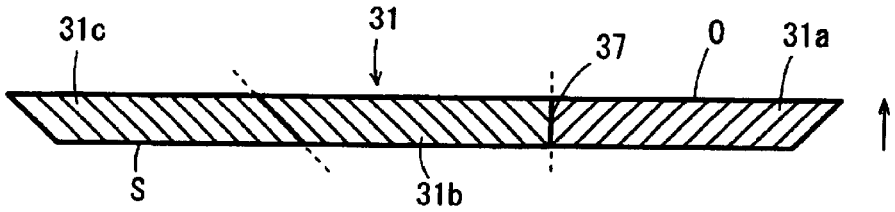
FIG. 11 shows a rough knitting method for obtaining the knitted fabric of the collar of the embodiment 2.
Figure 12:
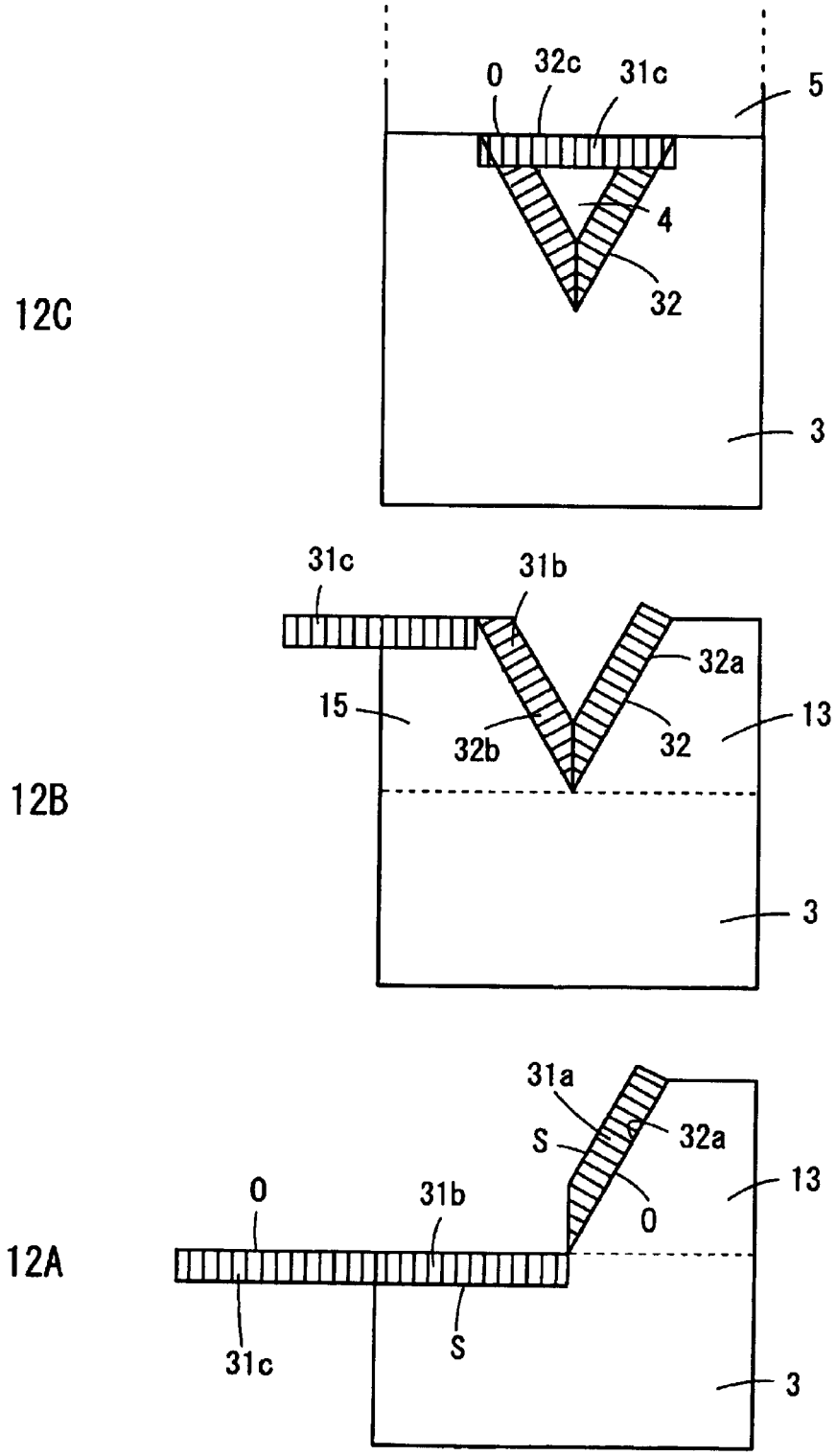
FIG. 12 schematically shows the joining process according to the embodiment 2 of joining the knitted fabric of the collar to the neckline of the vest.

Next, the knitting of a knitted fabric of a collar having a V-shaped neckline and the knitting of the V-shaped neckline will be described. The neckline of this embodiment does not have the flat portion formed in the base of the neckline of the embodiment 1, but has a neckline 32 comprising a first neckline portion 32*a*, a second neckline portion 32*b* and a third neckline portion 32*c*, instead. Also, the knitted fabric of the collar 31 comprises a first collar portion 31*a*, a second collar portion 31*b*, and a third collar portion 31*c*. FIG. 10 shows the knitted fabric of the collar 31 to be joined along the circumference of the V-shaped neckline 32. FIG. 11 schematically shows the knitting method for obtaining such a knitted fabric of the collar 31. In the knitted fabric of the collar 31, its cast-on portion S forms a front end of the collar and its cast-off portion O is joined to the neckline 32, as is the case with the former embodiment. Whenever the knitted fabric 31 is knitted by a predetermined number of courses, e.g., by two courses, the collar portions 31*a*, 31*b*, 31*c* are extended outwards from a V-butt line 37 as a center, to increase the knitting widths. As a result, the knitted fabric of the collar 31 has a large number of wales in the cast-off portion than in the cast-on portion, so that when the knitted fabric of the collar 31 is disengaged from the flat knitting machine, it has a V-shaped configuration as shown in FIG. 10. FIG. 12 schematically shows the joining process of the knitting for joining the knitted fabric of the collar 31 and the neckline 32. FIG. 12-A shows the state that after the left front body 13 is knitted, the collar portion 31*a* is joined to the first neckline portion 32*a*. FIG. 12-B shows the state that after the right front body 15 is knitted, the second collar portion 31*b* is joined to the second neckline portion 32*b*. FIG. 12-C shows the state that the third collar portion 31*c* is moved to an upper position of a neckline opening (FIG. 4-F).

Although the knitting method applied to the vest as knitwear has been described above, it is needless to say that the knitting method of the invention is applicable to a sleeved knitwear such as the one disclosed in Japanese Laid-open (Unexamined) Patent Publication No. Hei 6-184886. Also, although the U-shaped and V-shaped necklines have been illustrated above, it is needless to say that the knitting method of the invention is application to other configurations of the neckline such as a round shape. Also, although the knitting for joining the knitted fabric of the collar to the circumstance of the neckline opening of the front body and the integrally knitted back body has been described above, when only the front body is knitted, the knitted fabric of the collar may be knitted to have a knitting width corresponding to the front body or may alternatively be knitted to an extent that corresponds to the neckline of the back body with which the knitted fabric of the collar is stitched up together at a later stage. Also, although the third collar portion of the collar to be finally joined to the back body is located at the left side of the second collar portion of the collar in the embodiment illustrated above, the third collar portion may alternatively be located at the right side of first collar portion. The third collar portion may be divided into two parts to be located at the outside of the second collar portion and at the outside of the first collar portion, respectively.

Also, a stitch loop holding technique disclosed by Japanese Laid-open (Unexamined) Patent Publication No. Hei 11-43849, which is simply called "holding" function, is applicable to the knitting of the invention. When the holding technique is used, even the two-bed flat knitting machine can knit the knitwear seamlessly with all needles, without any need for previous reservation of the empty needles for the transference of stitches. A computer-aided flat knitting machine (Product name: SWG-FIRST) available from shima seiki mfg., Ltd. can be cited as a holding-function equipped knitting machine.

What is claimed is:

1. Knitwear with a collar knitted by a flat knitting machine, the knitwear comprising a front body and a back body, one of which is parted into a right body portion and a left body portion, and further comprising a neckline, wherein the neckline comprises at least three neckline portions comprising a first neckline portion formed at a lateral end of one of the right body portion and the left body portion which is formed earlier than the other, a second neckline portion formed at a lateral end of the other of the right body portion and the left body portion, and a third neckline portion formed in the body portion formed later, wherein a knitted fabric of the collar has a knitting width enough to be joined to an entire circumference of the neckline and comprises:

a) a first collar portion joined to the first neckline portion, b) a second collar portion joined to the second neckline portion, and c) a third collar portion located at an outside of the first and/or the second collar portions and joined to the third neckline portion, and wherein loops of the first neckline portion and loops of a final course of the first collar portion are joined to each other by forming double loops in the course of knitting of the body to form the first neckline portion in the body; then loops of the second neckline portion and loops of a final course of the second collar portion are joined to each other by forming double loops in the course of knitting of the body to form the second neckline portion in the body; and finally the third collar portion is moved to a neckline opening in such a condition that the loops of the third collar portion are arrayed in an opposite direction, so that the third neckline portion and the third collar portion are joined to each other by knitting a course of the body following the knitting of the loops of the final course of the third collar portion.

2. The knitwear with collar according to claim 1, wherein the knitted fabric of the collar is a V-neck knitted fabric, wherein whenever the knitted fabric is knitted by a predetermined number of courses, the collar portions are knitted to widen from a V-butt line of the V-neck as a center so that the knitted fabric of the collar can have a large number of wales in a cast-off portion thereof than in a cast-on portion thereof, and wherein the neckline is knitted to decrease the knitting width of the body so as to correspond in shape to the V-neck form.

3. The knitwear with collar according to claim 1, wherein the neckline is a round or square neckline further including a fourth neckline portion having a predetermined number of wales inserted in between the right body portion and the left body portion, and the knitted fabric of the collar has a fourth collar portion between the first collar portion and the second collar portion, the fourth neckline portion and the fourth collar portion being joined to each other by a binding-off knitting.

4. A method of knitting knitwear with collar by using a flat knitting machine, wherein a body comprising a front body and a back body, one of which is parted into a right body portion and a left body portion, and a knitted fabric of the collar knitted separately from the body are joined to each other in the course of knitting for forming a neckline in the body by using a flat knitting machine comprising at least a pair of first and second needle beds, which are extended laterally and confront each other in back and front and at least either of which can be racked laterally to transfer stitches between the needles beds, the method comprising:

a) the step of knitting the body from its hem to a forked portion at which the forming of the neckline is started, b) the step of knitting the knitted fabric of the collar separately from the body in parallel with or before or after the knitting of the body, c) the step of joining the knitted fabric of the collar to the body along circumference of the neckline, the step comprising the following steps:

c-1) the step of joining the knitted fabric of the collar to one body portion of the right and left body portions by overlapping loops of a collar portion of the knitted fabric of the collar confronting the one body portion, which extends from near a center of a knitting width of the knitted fabric of the collar to one outer end of the same, with a loop at a lateral end of the one body portion one after another from a loop near the center of the knitted fabric in the course of knitting the one body parted into the right body portion and the left body portion, and c-2) the step of joining the knitted fabric of the collar to the other body portion of the right and left body portions by overlapping loops of a collar portion of the knitted fabric of the collar confronting the other body portion, which extends from near a center of a knitting width of the knitted fabric of the collar to the other outer end of the same, with a loop at a lateral end of the other body portion one after another from a loop near the center of the knitted fabric in the course of knitting the other body.

5. The method of knitting knitwear with collar by using the flat knitting machine according to claim 4, wherein the neckline has a flat neckline portion having a predetermined number of wales inserted in between the right body portion and the left body portion, and the flat neckline portion is joined to the collar portion of the knitted fabric of the collar located at a center of the knitting width by a binding-off process, followed by the step of the process c).

6. The method of knitting knitwear with collar by using the flat knitting machine according to claim 4, wherein the knitted fabric of the collar is knitted to have a larger kitted width than a collar portion joined to the body around a neckline portion defined by lateral ends of the right and left body portions, so as to allow the knitted fabric of the collar to be joined to the body all around the neckline.

7. The method of knitting knitwear with collar by using the flat knitting machine according to claim 6, wherein the body is knitted in such a manner that one of the front and back bodies is knitted from its hem to its shoulder and then the other is knitted to its hem continuously, so that the front body and the back body are knitted continuously along the shoulder, and also the neckline closed at an entire circumference thereof is formed in the course of knitting of the body, and wherein after the knitted fabric of the collar is sequentially joined to the neckline of the body knitted in sequence, the rest of the knitted fabric of the collar left without being joined to the neckline is place between the right body portion and the left body portion in such a condition that the loops of the rest of the knitted fabric of the collar are arrayed in an opposite direction and is joined to the body by performing a course knitting following the knitting of loops of that collar portion and loops of the body knitted to be parted right and left.

* * * * *